United States Patent [19]

Sapp et al.

[11] Patent Number: 4,924,792

[45] Date of Patent: May 15, 1990

[54] HIGH SPEED PLANING BOAT

[75] Inventors: Samuel C. Sapp, Ocala, Fla.; Peter R. Payne, Stevensville, Md.

[73] Assignee: Marine Technological Exchange, Inc., Ocala, Fla.

[21] Appl. No.: 295,231

[22] Filed: Jan. 9, 1989

Related U.S. Application Data

[63] Continuation-in-part of Ser. No. 158,098, Feb. 16, 1988, which is a continuation of Ser. No. 720,289, Apr. 5, 1985, abandoned.

[51] Int. Cl.[5] ..... B63B 1/18

[52] U.S. Cl. ..... 114/61; 114/290; 114/271

[58] Field of Search ..... 114/56, 57, 61, 271, 114/283, 288, 290, 291; D12/312

[56] References Cited

U.S. PATENT DOCUMENTS

| | | | |
|---|---|---|---|
| 2,995,104 | 8/1961 | Mills | 114/56 |
| 3,160,134 | 12/1964 | Hillman et al. | 114/290 |
| 3,602,179 | 8/1971 | Cole | 114/290 |
| 3,709,179 | 1/1973 | Payne | 114/56 |
| 3,763,810 | 3/1972 | Payne | 114/56 |
| 3,807,337 | 4/1974 | English et al. | 114/56 |

FOREIGN PATENT DOCUMENTS

| | | | |
|---|---|---|---|
| 1044533 | 12/1978 | Canada | 114/56 |
| 317054 | 4/1930 | United Kingdom . | |

OTHER PUBLICATIONS

Payne, "Supercritical Planing Hulls", Ocean Engineering, (vol. 11, No. 2, pp. 143-159, 1984).

Payne, "The Dynamic Force on a Two-Dimensional Planing Plate of Arbitrary Cumber", Ocean Engineering, (vol. 9, No. 1, pp. 47-64, (1982).

Stebbins, "Seaknife Arriving", Proceedings U.S. Naval Institute, vol. III/2 1984, Feb. 1985, pp. 113-118.

Payne, "The Wavestrider Family of Planing Boats" (technical disclosure).

*Primary Examiner*—Joseph F. Peters, Jr.
*Assistant Examiner*—Edwin L. Swinehart
*Attorney, Agent, or Firm*—Howard L. Rose

[57] ABSTRACT

A pleasure boat having a rectangular passenger area for operation at high speeds in moderate seas, planes on ski-like planing surfaces on the bottom of laterally spaced, knife edge hulls located on the starboard and port sides of the craft and the stern end of a wedge shaped bottom rounded to assist in turns; the rounded bottom also having flutes to improve tracking and strakes to assist in the lift and to divert spray from the craft; the two forward hulls terminating in tunnels located along either side of the rounded bottom to reduce greatly the surface area in the water and to provide lift to assist in planing.

18 Claims, 2 Drawing Sheets

HIGH SPEED PLANING BOAT

This is a continuation-in-part of application Ser. No. 158,098 filed Feb. 16, 1988 which is a continuation of application Ser. No. 720,289 filed Apr. 5, 1985, now abandoned.

BACKGROUND OF THE INVENTION

The present invention relates to high-speed pleasure boats and more particularly to a very stable, fuel efficient maneuverable, high speed craft for operation in light to lower moderate seas and having a large rectangular passenger area.

DESCRIPTION OF THE PRIOR ART

High speed planing boats, hydroplanes, are well known for their ability to achieve combined high-speeds and maneuverability. The ride of these craft is quite uncomfortable, bouncing from wave to wave, skidding in turns and flipping over backwards if the aerodynamic lift on the forward part of the boat becomes too great. Also, the classic hydroplane provides a quite small passenger compartment.

Attempts to improve the performance of the hydroplane have taken many routes, a number of which are discussed in the article "Supercritical Planing Hulls", Ocean Engineering, Vol. 11 No. 2 pp 129–184 by Peter R. Payne, one of the inventors of the present invention. Additional planing craft are found in U.S. Pat. Nos. 3,709,179 and 3,763,810 of Peter Payne. See also the article "Sea Knife Arriving" by John Stebbin, pp 113–118, Proceedings, U.S. Naval Institute, Feb. 1985, Vol. 111/2/984.

Each of the craft described in the aforesaid literature and the literature including patents are constructed such that for the size of the craft, the passenger area is small. The craft are designed primarily for speed and maneuverability, often for combat and/or racing and sacrifice passenger area and creature comfort to these ends.

SUMMARY OF THE INVENTION

It is an object of the present invention to provide a fuel efficient, high-speed, maneuverable, pleasure craft for operation in sheltered water, having a large passenger area and providing a comfortable, stable ride.

The craft of the present invention has a pair of laterally spaced symmetrical planing hulls or sponsons located forward on the craft and a wedge shaped bottom having maximum width at the transom and providing a third planing surface. The forward planing hulls provide one planing surface each and have knife edge, leading edges to permit the craft to cut through waves to reduce drag and hold the central planing surface at the optimum trim angle for efficient (low drag) planing. The front hulls also carry S-shaped spray rails to direct spray from the passenger area. The spray rails carry down to just above the planing surface and to the rear of the sponsons to reduce the wetted surface at planing. A third, central planing surface is provided by a wedge shaped bottom of the boat with the craft planing on the rear end of such surface.

As noted above, the transverse planing hulls are employed to hold the central planing surface at the optimum trim angle for minimum resistance.

The load on the sponsons varies with the location of the center of gravity of the boat and with other moments which affect its trim angle. Examples are the propeller thrust and the aerodynamic lift due to the window of the deck, both of which tend to reduce the load on the sponsons. Typically, the sponsons carry about one third of the boat's weight between them; that is one sixth of the weight per sponson.

A single forward hull is not employed since it would adversely effect the ability to plane on the rear planing surface. Thus the two widely separated forward hulls are employed. Symmetrical hulls are employed to prevent yawing of the craft in turns and in the presence of waves striking the boat at an angle to its centerline. The rear of the forward planing surfaces of the hulls may carry downwardly depending hooks to increase the lift of these surfaces.

The front hulls terminate in tunnels running down each side of the wedge which tunnels add lift to the craft when coming up to its planing position and during planing greatly reduce the wetted surface of the craft to only that required to produce planing.

The disposition and size of the three planing surfaces and the low height of the tunnel result in a craft which has a very shallow draft at low speeds. The draft at rest of one such craft, twenty feet long and weighing three thousand pounds was ten inches.

The wedge shaped bottom of the craft is preferably rounded in cross-section to soften the ride on a light chop and to prevent the chines of the wedge from digging into the water on turns and thus improving the ability of the craft to hold a turn. The wedge is also provided with flutes to assist in holding a heading and strakes which assist in holding a turn, and assist in diverting spray away from the passenger area. A V-shaped bottom or flat bottom for the planing surfaces may be employed, the latter sacrificing ride comfort but increasing efficiency and therefore speed.

BRIEF DESCRIPTION OF THE DRAWINGS

FIGS. 7-1 to 7-3 are a series of crosssectional views taken in FIG. 2 illustrating the configuration of the boat at various locations rearward of the back of the front hulls, and FIGS. 8-1 to 8-2 are a series of crosssectional views taken in FIG. 2 illustrating the configuration of the craft at the back of and forward of the rear of the front hulls.

DETAILED DESCRIPTION OF THE PRESENT INVENTION

Figure 1:
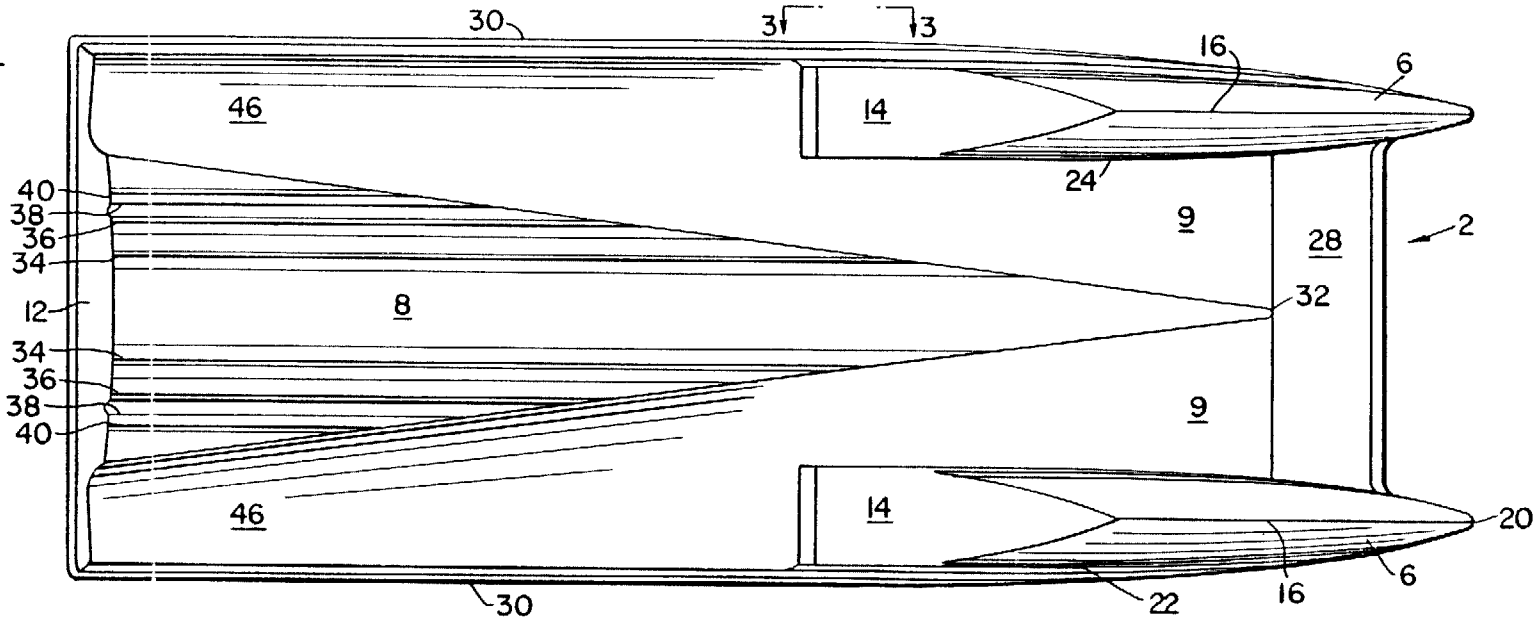
FIG. 1 is a bottom view of the boat of the present invention.

Referring now to FIGS. 1, 2, 4 and 6 of the accompanying drawings, the craft 2 comprises an upper, generally rectangular part 4, a pair of laterally separated front hull members 6, and a rounded wedge 8 formed on the bottom 9 of the craft.

The wedge 8 may be inclined between 2° and 6° to the line 10 drawn between the bottom of the wedge 8 at transom 12 and the bottom rear of the forward hulls 6. In the specific craft being considered the angle is 4° at sponsons; the same angle the bottom of the hulls 6 (hereinafter referred to as the planing surfaces 14) make with horizontal line 10. The optimum angle for a flat planing surface varies to some degree with the aspect ratio of the plate. See page 79 of Planing by Peter Payne, published by Fishgate, Inc., 1988. The angle is higher for V-shaped and rounded bottom boats.

The hulls 6 are identical and thus only one is discussed. The hulls are symmetrical and have relatively sharp leading edges 16 which slope upwardly along a continuous curve 18 to a narrow rounded end 20 at each of the prows of the craft.

The hulls 6 are provided with both inner and outer spray deflectors 22 and 24, the inner deflector terminating at the front of the ski region and the outer deflector carrying to the end of the ski. Both sets of deflectors 22 and 24 are S-shaped and carry from near the top front of the hulls to near the bottom at the back of the sponsons; thus providing spray protection for both low and high waves. As previously indicated, the fact that the outer spray rails 24 provide, in effect, a notch 25 in the outer edge of the sponson that serves the twofold purpose of a spray rail and a means of reducing the wetted surface of the sponson.

Figure 3:
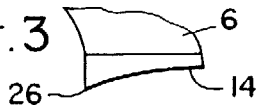
FIG. 3 is a detailed side view of the hooked surface at the rear of the front skis.
Figure 2:
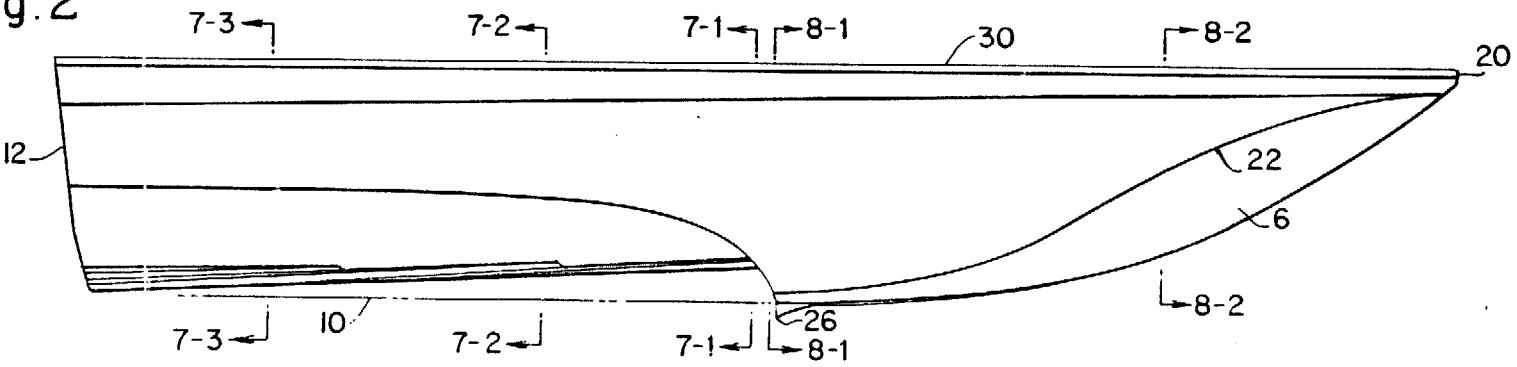
FIG. 2 is a side view in elevation of the invention.

The rear of the planing surfaces 14, and reference is made to FIG. 3 of the accompanying drawings, is curved downwardly to provide a relatively flat downward hook 26 which provides additional lift to the front sponson.

The craft has a flat bow 28 commencing rearwardly of the leading edges 20 of the hulls 6 by a short distance sufficient to permit the hulls 6 to knife into incoming waves before encountering the main body of the boat. Thus a large dynamic force that would tend to lift the bow in small waves is substantially avoided. This sloping surface provides the additional function of preventing swamping of the craft in heavy seas. If a large wave is encountered the bow lying at about 45° to the horizontal, produces a large vertical force and serves to raise the bow, permitting the wave to pass under the craft and down through the tunnels. Otherwise a rush of water would sweep through the passenger compartment(s) and wheelhouse.

The wedge 8 commences at the intersection of the bow transom and the bottom 9 of the craft. The wedge tapers outwardly to the rear at an angle determined by the width of the craft and the width of tunnels to be described subsequently. In the particular realization of the invention illustrated, the outward taper of each side of the wedge relative to the centerline of the craft is 7 ½°, going from a virtual point 32 to about 52"at the transom 12. The stern of the craft in question is about 87" wide.

Figure 4:
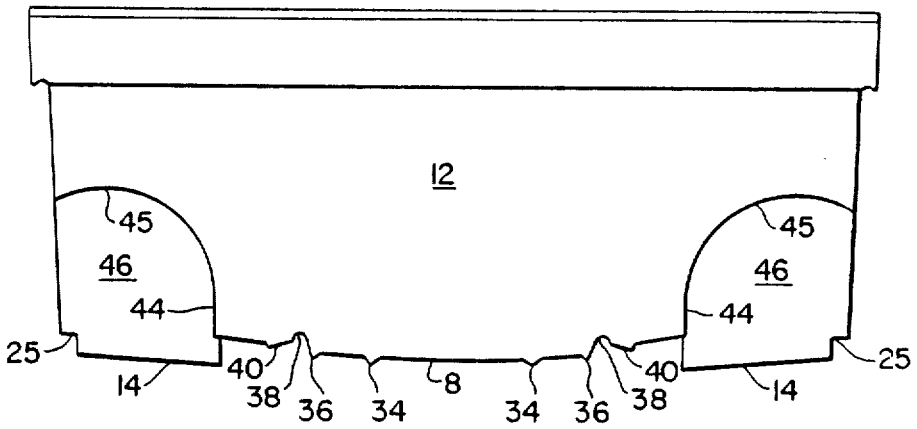
FIG. 4 is a rear view of starboard half of the boat of the present invention.
Figure 5:
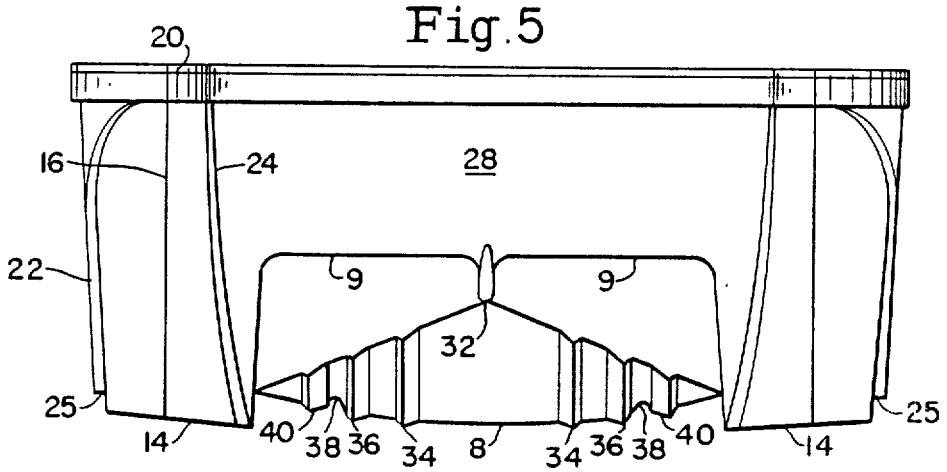
FIG. 5 is a front view of the starboard half of the craft.
Figure 6:
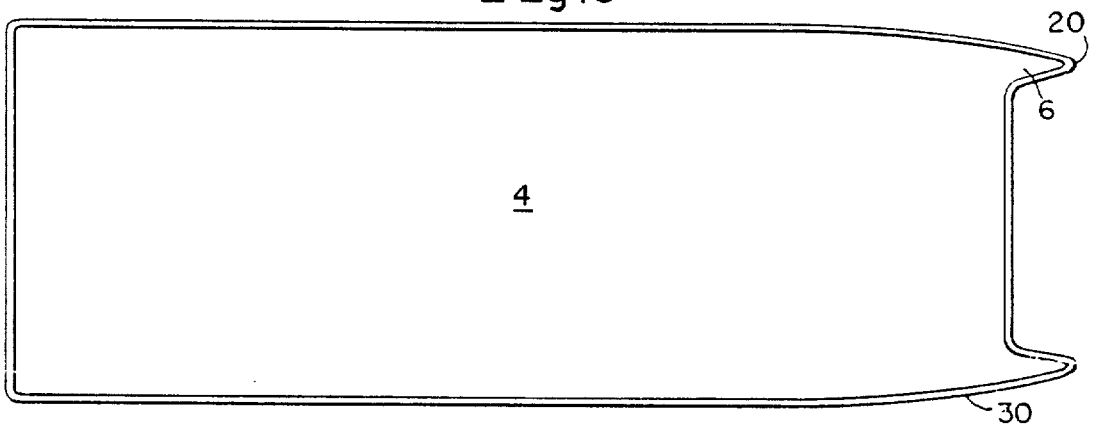
FIG. 6 is a top plane view of the craft.
Figure 7:
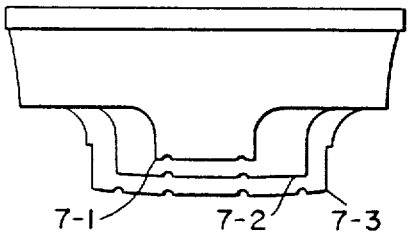
Figure 8:
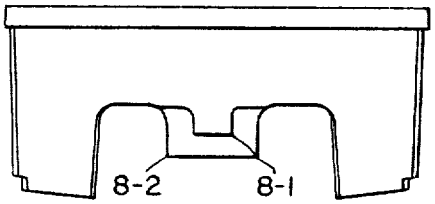

In this embodiment of the invention, the bottom of the planing wedge is rounded in the cross-section view as illustrated in FIG. 4 of the accompanying drawings. The radius of curvature of the bottom of the wedge is about 92" for this particular craft. The bottom of the wedge is provided with six longitudinally extending strakes, three, numbers 34, 36 and 38 on each side of the centerline of the craft with the innermost strake spaced apart a sufficient distance so as not to introduce significant amounts of air bubbles to the propeller which in this embodiment is intended to be a surface piercing propeller. Located between strakes 38 and 40 on both sides of the centerline of the wedge 8 are longitudinally extending grooves 40 which help reduce yawing of the craft and hold it on course while producing some lift.

The strakes provide some lift during rise to planing and while on plane operate as spray diverters. The rounded bottom of the wedge 8 prevent chines 42 of the wedge from digging into the water on turns, reducing drag and helping to hold the turn. Specifically, the rounded bottom reduces shock and allows banking to provide better turning at slow speeds; behaving like a flat bottom at high speeds.

The sides 44 of the wedge rearward of the hulls 6, rise sharply and terminate in surfaces 45 of large radius, in the embodiment illustrated, a radius of about 12". These surfaces define tunnels 46 extending from the rear of the hulls 6 to the stern transom, greatly reducing the area of the craft engaging the water, providing lift when in the water with the craft rising to the planing position and serve as spray diverters when planing. The vertical rise of the sides of the planing wedge also serves to limit the dynamic forces acting on the bottom of the craft to only those required for planing and thus reduces the excess forces that would result in pounding of the craft.

The craft described above has a rectangular deck area much like a house boat and is intended for pleasure use in light to lower moderate seas but may be adapted to other uses where high speed, maneuverability and a large passenger area are desired. The length to width ratio, ideally 2:1 to 3:1 is, in this rendition, 2:68:1 and is 21 ft. long. In test of this craft using a 115 horsepower outboard engine with a submerged propeller, speeds of slightly over 51 miles per hour were attained. The craft is capable of carrying a 200 horsepower outboard engine and may be adapted to an inboard engine with a submerged propeller. In the tests conducted on the craft, which weighed about 3000 pounds with one person and all equipment aboard, and in waves of 1.5 feet, the craft experienced no loss of speed or efficiency. Based on these tests, it has been calculated that with a Mercedes 5 cyl. engine of 130 shaft horsepower, the craft will attain a speed of approximately 50 MPH and a fuel efficiency of 10 miles/gal. at wide open throttle and 15 +MPG at cruise speeds of approximately 35–40 MPH.

It was found that only about the last four feet of the wedge 8 and one foot each of skis 6 were in water and the front skis rode on the surface of the water. The skis in this rendition were about 16" wide. It is apparent that the wetted surface of the craft was quite small and thus the high efficiency. The very small area of wetted surface, less than 14 square feet for a 3000 lb. craft (approximately 215 lbs. per square foot) in this rendition, results from the use of the tunnels to reduce the wetted surface of the wedge; the height of the tunnel being effective to minimize wetting along the sides of the wedge and adjacent surfaces of the bottom of the boat. The length of the wedge in water when planing is defined also to a great extent by the placement and angle of the front skis. In waves, the front edges of the hulls which hold the wedge at the proper angle of attack cut through the waves; the rear of the wedge following whereby to reduce vertical accelerations of the boat to relatively comfortable levels even in seas of up to three feet. It has been found that the rear of the sponson should extend no greater than 50% of the length of the boat from the bow; specifically 10'4" in a boat of 20'11"in length.

The high efficiency of the craft is partly due to the low wetted area as noted. But another important point is that both the sponsons' planing surfaces and the central planing surface run at an angle which is close to optimum for induced drag or pressure drag, that is the induced drag is a rearward inclination of the lift force. Conventional boats which run on a single point rarely are able to maintain the optimum angle of approximately 4° because some of the other influences like the aerodynamic lift, propeller thrust and the location of the center of gravity tend to change the angle. In particular at high speeds conventional boats tend to run at very small angles of a degree or less so that they have considerably more wetted area than is required thus producing much greater drag.

In summary, the craft planes on three surfaces such that the bow of the craft can be quite wide; the weight thereof being carried by the narrow front sponsons which also serve to maintain the rear planing surface at the proper angle of attack. The front of the forward hulls are knife edged to permit the craft to knife through waves instead of riding the crests and this together with the sloping forward transom maintains pitching in light to low moderate seas to relatively low levels. Tunnels to the rear of the skis and along the sides of the wedge, reduce the surface in contact with water to the minimum required to support the fully loaded craft, thus minimizing drag to a level far below that found in deep-V high performance hulls. The three surfaces of support permit an unusually shallow draft for a boat of such size and weight; only 10 inches in the boat that was built and tested. The craft maintains close to maximum speed in waves up to three feet. Maneuverability and turning is enhanced by the use of a rounded bottom on the wedge and the use of strakes and flutes.

Depending upon the desired end use of the craft, angles of attack, radius of curvature of the bottom of the wedge, flat surface area of the skis and the like may be varied to accommodate specific needs. Thus it is apparent that minor variations in design are possible without violating the teachings or spirit of the present invention. The passenger area can be configured as desired with stark or luxurious fittings and controls, deck covering structures, sleeping accommodations and the like. The craft, due to its shallow draft, is ideal for lake fishing or because of speed and maneuverability for racing or warfare. For instance the ride can be softened by increasing the dead rise of the skis and/or making the front transom and planing surface in a V-shape. The former modification will reduce the speed of the craft and the latter modification will reduce its efficiency but both reductions will not be great and the ride will be noticeably smoother.

Although not illustrated, since it forms no part of the present invention, the cockpit area in one form will be about 101 square feet, leaving free space of 63 sq. feet in a 21 foot long craft; thus comparing favorably with craft of 30 feet or more in length.

Other improvements, modifications and embodiments will become apparent to one of ordinary skill in the art upon review of this disclosure. Such improvements, modifications, and embodiments are considered to be within the scope of this invention as defined by the following claims.

We claim:

1. A high speed, high efficiency planing boat comprising:

a top area of said boat having a bottom defining the bottom of said boat, a transom, a pair of forward sponsons depending downwardly from said bottom of said boat and extending toward the transom about half the length of the boat, said sponsons being spaced apart and lying on opposite sides of the longitudinal centerline of said boat, each said sponson having a flat planing surface toward the rear thereof, a generally flat wedge-shaped member extending downwardly along said bottom of said boat having its apex lying below and adjacent the bow between said sponsons along the longitudinal centerline of the boat and extending to the stern of the boat the width of the wedge at the transom approximating the spaced apart distance between said sponsons, each said sponson having a wall along an inner side thereof adjacent said wedge and rising generally vertically toward the bottom of said boat, said wedge having a generally vertical wall along each side thereof extending toward the bottom of said boat, said generally vertical walls of said sponsons and said wedge shaped member defining in the forward half of the bottom of the boat tunnels whereby to reduce the wetted area of the boat.

2. A high speed, high efficiency planing boat according to claim 1, wherein said top area is generally rectangular.

3. A high speed, high efficiency planing boat according to claim 1, wherein said planing surfaces and said wedge-shaped member are inclined upwardly from stern to bow relative to said bottom of said boat whereby to further reduce the wetted area of the bottom of the boat.

4. A high speed, high efficiency planing boat according to claim 3 wherein said angle of inclination is in the range of approximately 2°–6°.

5. A high speed, high efficiency planing boat according to claim 1 or claim 3, wherein said sponsons are tapered to a generally shape downwardly and rearwardly curved leading edge, said leading edges flaring outwardly into said planing surfaces toward the rear of said sponsons.

6. A high speed, high efficiency planing boat according to claim 5, wherein said boat has a bow portions extending between said sponsons rearwardly of the leading edges of said sponsons and sloping downwardly and rearwardly.

7. A high speed, high efficiency planing boat according to claim 6, wherein said apex lies at the intersection of said bottom and said bow.

8. A high speed, high efficiency planing boat according to claim 1, wherein said sponsons and said wedge shaped member are positioned to cause said sponsons to carry approximately one-third of the weight of said craft on planing.

9. A high speed, high efficiency planing boat according to claim 5, wherein said sponsons include spray deflectors.

10. A high speed, high efficiency planing boat according to claim 9, wherein said sponsons each have along their outer surfaces said spray deflector comprising an S-shaped notch having its highest point adjacent the upper end of said bow and extending to the rear of each said sponson in a generally smooth curve to a short distance above said planing surface.

11. A high speed, high efficiency planing boat according to claim 1, wherein said walls of said wedge shaped member rearwardly of said sponsons extend essentially vertically from the bottom of the wedge and curve outwardly adjacent said bottom merging into a continuous curve terminating in a downwardly depending region to provide spray deflectors.

12. A high speed, high efficiency planing boat according to claim 1, wherein said wedge-shaped member further includes a bottom surface having longitudinally extending strakes symmetrically disposed relative to the centerline of said boat.

13. A high speed, high efficiency planing boat according to claim 1 or claim 12, wherein said wedge-shaped member includes a bottom surface having a plurality of longitudinally extending flutes dispersed symmetrically with respect to the centerline thereof.

14. A high speed, high efficiency planing boat according to claim 1 or claim 12, wherein said wedge shaped member has on a large radius of curvature, a slightly curved bottom in transverse section adjacent the stern.

15. A high speed, high efficiency planing boat according to claim 1 wherein the weight to the square foot of wetted surface in planing is approximately 215 pounds to 1.

16. A high speed, high efficiency planing boat according to claim 1, wherein said planing surfaces terminate at their stern end at a distance from the bow of said boat of not greater than approximately 50% of the distance from said bow to the stern of said boat.

17. A high speed, high efficiency planing boat according to claim 1, wherein said planing surfaces have a shallow downward curve at their stern ends.

18. A high speed, high efficiency planing boat according to claim 1 wherein said bow upon planing of said boat makes a 45% angle with the horizontal.

* * * * *